United States Patent [19]

Rossaert

[11] 3,971,516

[45] July 27, 1976

[54] DEVICE FOR WINDING TOROIDAL DEFLECTION COILS

[75] Inventor: Edgard Emile Charles Rossaert, Dilbeek, Belgium

[73] Assignee: U.S. Philips Corporation, New York, N.Y.

[22] Filed: June 18, 1974

[21] Appl. No.: 480,539

[30] Foreign Application Priority Data

June 22, 1973 Netherlands ..... 7308700

[52] U.S. Cl. ..... 242/4 B

[51] Int. Cl.[2] ..... H01F 41/08

[58] Field of Search ..... 242/4 C, 4 B, 4 BE, 242/4 A, 4 R, 6; 29/203 R; 140/92.2

[56] References Cited

UNITED STATES PATENTS

| | | | |
|---|---|---|---|
| 2,726,817 | 12/1955 | Barrows | 242/4 B |
| 3,400,894 | 9/1968 | McIntosh et al. | 242/4 B |
| 3,559,899 | 2/1971 | Fahrbach | 242/4 B |
| 3,766,641 | 10/1973 | Metzler et al. | 242/4 R X |
| 3,799,462 | 3/1974 | Fahrbach | 242/4 B |

*Primary Examiner*—Edward J. McCarthy
*Attorney, Agent, or Firm*—Frank R. Trifari; David R. Treacy

[57] ABSTRACT

An apparatus for slant winding of toroidal deflection coils. A first wire guide is pivotally mounted at the area of the end face of the core having the smaller diameter. A second wire guide, arranged on an annular plate rotatable about the same axis as the core, at the area of the end face of the core having the larger diameter is formed by two wire interceptors which laterally fan out from the core edge such that one of the wire interceptors always intersects the plane of the winding wheel.

6 Claims, 2 Drawing Figures

DEVICE FOR WINDING TOROIDAL DEFLECTION COILS

Figure 1:
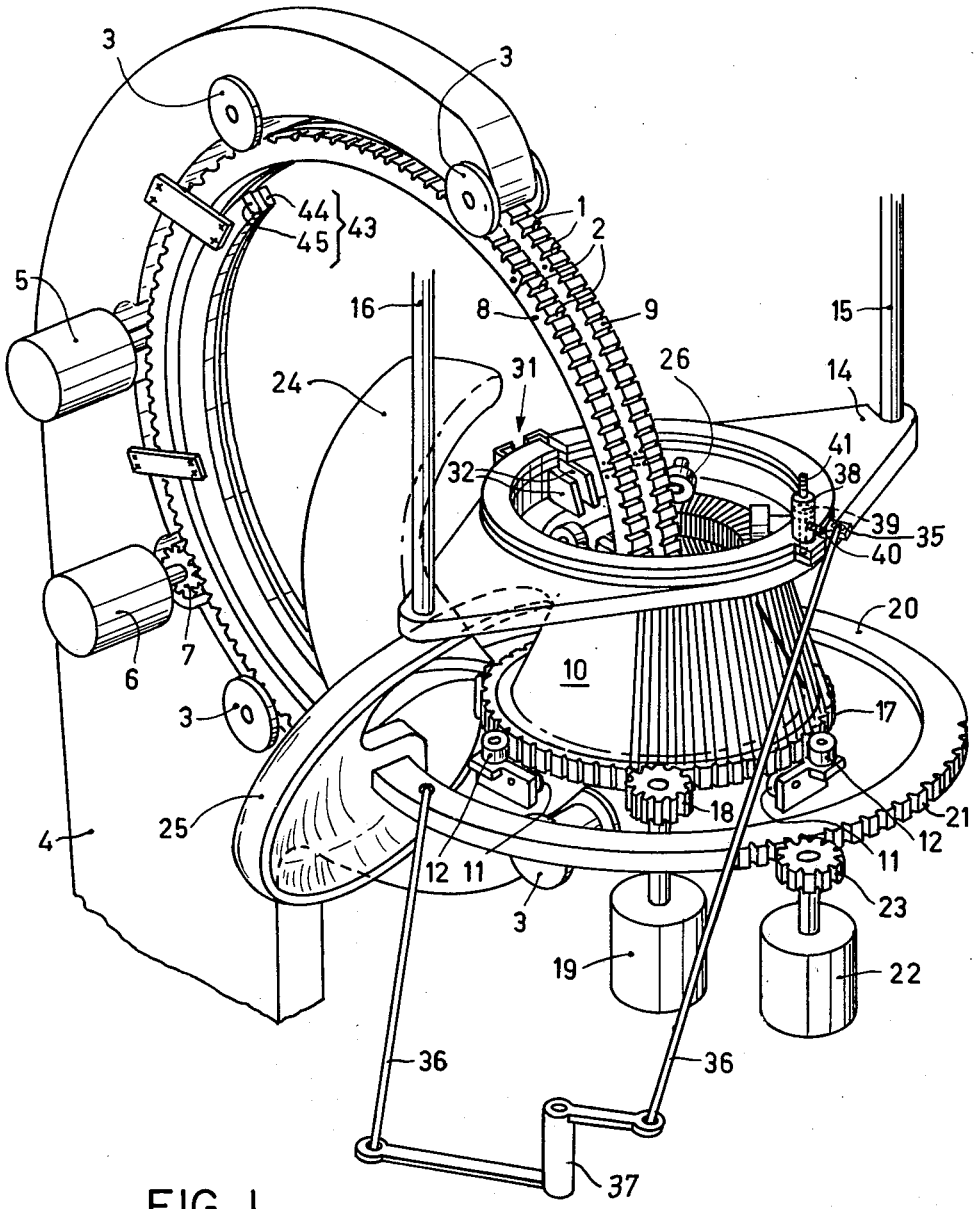

The invention relates to an apparatus for winding toroidal deflection coils, in particular for the slanted winding of such coils, about a toroidal core. Such a device has a rotatable winding wheel with a wire take-off and braking device, a detachable part of the wheel, through which the core can be inserted, means for holding and rotating the core, and a first wire guide at the area of the end face of the core having the smaller diameter.

A device of this kind is known from U.S. Pat. No. 3,559,899. In this known device a toroidal core can be provided with windings, each of which is situated in a plane which extends through the axis of the core. However, this basic type of winding machine is not intended for the production of slanted windings, that is windings which are situated in planes which intersect the axis of the core. In some circumstances a slanted arrangement of the windings on the core may be desired so as to obtain the desired magnetic fields.

The object of the invention is to provide an apparatus for winding toroidal coils with slanted as well as straight windings in any desired pattern and accuracy. According to the invention, at least at the area of the end face of the core having the larger diameter, a second wire guide is arranged on an annular plate pivotable about the same axis as the core, this wire guide being formed by two wire interceptors which laterally fan out from the core edge so far that in each position of the wire guide one of the wire interceptors intersects the plane in which the winding wheel is situated.

With this the wire can be accurately positioned in any desired location on the end face having the larger diameter by arrangement of the second wire guide in the desired location on the circumference of the core. From this point the wire extends over the core to the first wire guide which deposits the wire in a location on the other end face of the core. This location is always situated in the plane of the winding wheel. Any desired course of the windings can thus be very accurately obtained, i.e. slanted as well as straight windings can be deposited.

To ensure that the wire is deposited in the correct location on the end face having the smaller diameter, in a further preferred embodiment the first wire guide is rotatable about an axis situated in the plane of the winding wheel and which is substantially tangent to the outer circumference of the relevant end face, the two wire guides being coupled to each other such that the inlet of the first wire guide always points in the direction of the second wire guide.

With a movable inlet guide directed according to the invention, wire which arrives at a given degree of slant is always deposited in the correct location on the end face. If the first wire guide were stationary, the deposition of the wire would be liable to be incorrect, particularly in the case of higher degrees of slant.

In a further preferred embodiment the second wire guide is connected to a drive unit which is capable of positioning this wire guide with respect to the core in accordance with an adjustable program that is, according to a predetermined relationship between wire guide position, core rotation and winding wheel movement.

In yet another embodiment the first wire guide is formed by two first structural parts which extend in parallel at some distance from each other and which are each rotatable about a first axis which is transverse to the plane of the winding wheel and which are connected to a further structural part which is journalled to be rotatable about a common second axis which is situated in the plane of the winding wheel in a yoke which is movable in the axial direction of the core along one or more guides and which is furthermore provided with a number of rollers which are capable of pressing the upper edge of the core, the further structural parts being connected to an annular plate which is coupled to the second wire guide, the first structural parts being connected to a lever which is pivotable about the first axis by way of a drive unit.

For the rotation of the core the device comprises a motor which is capable of driving a gearwheel, toothed rack or toothed belt in accordance with an adjustable program, the gearwheel, toothed rack or toothed belt being capable of engaging a gearring provided on the core. Very accurate digital control of the core displacement is thus possible.

In still another preferred embodiment according to the invention over the part of the path of the winding wheel from which the wire is taken off during the deposition of the winding on the inner surface of the core, two parts of rings extend which are situated at some adjustable distance from the inner circumference of the winding wheel, the wire being guided between the ring parts. The sides of the rings which face each other are rounded in accordance with well-known practice.

If these rings are properly adjusted and shaped, the wire is guided such that it extends on the inner surface of the core in the form of a geodetic line; that is, the shortest line between the contact points on the upper and lower end faces. This winding technique has the advantage that the wires cannot shift so as to come loose.

In a further preferred embodiment yet, the part of the two rings which is situated inside the core is pivotably connected to the other part of the rings. The latter, most important part of the rings can thus be quickly adapted to any changing circumstances.

The invention will be described in detail hereinafter with reference to the accompanying drawing.

Figure 2:
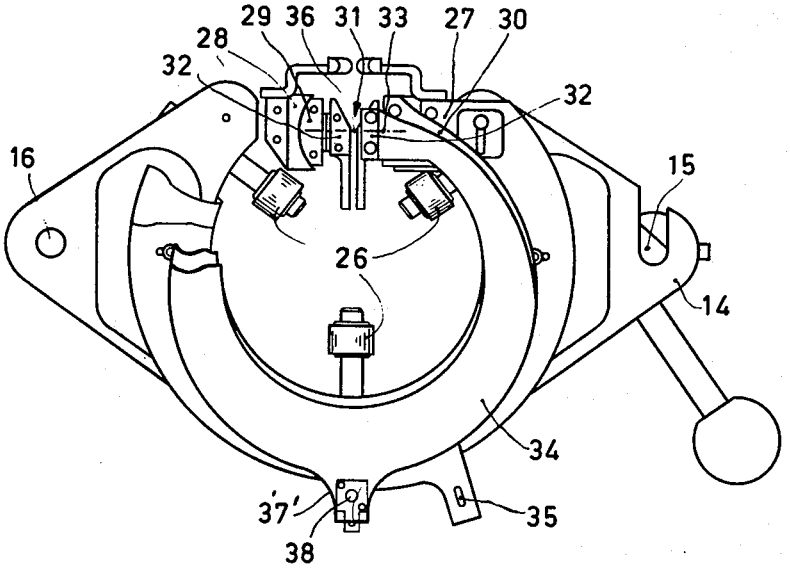

FIG. 1 is a diagrammatic perspective view of a winding device according to the invention, FIG. 2 is a more detailed plan view of the movable first guide of the device shown in FIG. 1.

The device shown in FIG. 1 comprises a winding wheel 1 and a feed reel 2 of known construction, so the construction and operation thereof will not be elaborated herein. The winding wheel 1 and the feed reel 2 are mounted in a frame 4 by way of guide wheels 3. The winding wheel 1 is provided with a gear ring which is coupled to a drive motor 5 by way of a gearwheel, while the feed reel 2 can be braked or driven by a motor 6 by way of gearwheel 7.

The winding wheel 1 and the feed reel 2 each comprise a part 8, 9 which can be swung out and along which a toroidal core 10 of, for example, ferrite material can be slid over winding wheel and feed reel and be placed on rollers 11, 12 which support the core and lock it against lateral sliding.

The core 10 has connected thereto a gear ring 17 in which a gearwheel 18 connected to a motor 19 engages.

An annular flange 20 is arranged to be pivotable about the gear ring 17, part of said flange being provided on its outer side with teeth 21. The flange 20 can be rotated by a motor 22 by way of a gearwheel 23. Provided on the flange 20 is a second wire guide which consists that a two wing-shaped wire interceptors 24 and 25 positioned so thata wire being placed on the core will pass between the interceptors. The side of the wire interceptors 24 and 25 which faces the gear ring 17 virtually contacts the teeth of the gear ring 17. The wings 24 and 25 fan out to both sides so far that even in the most extreme positions one of said wings still intersects the plane of the winding wheel 1, so that the wire taken off from the winding wheel is always intercepted by one of said wings and is guided to the core.

The core is pressed on its upper side by a number of rollers 26 which are connected to a yoke 14 which is vertically adjustable along columns 15 and 16. During the insertion or removal of a core 10, the yoke 14 and everything connected thereto is uncoupled from column 15 and swung away about column 16.

The yoke 14 is shown in a plan view in FIG. 2. A plate 27 is adjustably connected to the yoke 14, the plate supporting structural parts 28 fastened to that plate, which have a cylindrical inner surface. Pivotably arranged in the structural parts 28 are the parts 29 which have a cylindrical outer surface and which are connected to an annular flange 30. The parts 29 have connected thereto a first wire guide 31 consisting of two parts 32 which are pivotable about a split shaft 33 coupled to the parts 29. The parts 32 are connected to an annular flange 34.

The annular flange 30 which is connected to the parts 29 bears on and can slide across the plate 27 which is adjustably connected to and bears on the yoke 14. At the area 35 the flange 30 is connected, by way of a system or rods 36, to the ring 20 on which the second wire guide interceptors 24, 25 are secured. These rods are interconnected by any wellknown means, such as the off-set lever 37 shown schematically, so that the flange 30 and ring 20 rotate in synchronism. Consequently, when the ring 20 is turned, i.e. in the case of displacement of the wire guide interceptors 24, 25, the first wire guide 31 will also be turned about the shaft 33 which is so positioned by adjustment of the plate 27 that this shaft virtually contacts the outer circumference of the ring on the upper side of the core. As a result of this kind of coupling of the two wire guides, in each position of the wire guide interceptors 24, 25, determining the angle at which the windings are deposited on the core, the upper wire guide 31 occupies a position such that the wire which arrives over the inner surface of the core can readily slide into the grooves of the end face having the smaller diameter.

In order to ensure that the wire guide 31 touches the core surface or the already wound wire and that the distance between each of these surfaces and the wire guide is approximately constant so as to ensure proper operation of the wire guide, a facility has been provided by means of which the annular flange 34 can be slightly lifted at the area 37. As a result, the parts 32 are slightly rotated about the shaft 33, so that the lower side of the parts 32 is always at the correct distance from the core surface or wire surface situated therebelow.

The lifting of the flange 34 can be effected in various manners.

In the device shown in the drawing, the flange 34 supports a cylinder 38 in which a piston 39 is accommodated which is permanently connected, by way of a piston rod, to the flange 30. The cylinder 38 comprises two compressed air inlets 40 and 41 via which air can be admitted below or above the piston as desired, so that the flange 34 is either pressed upwards or downwards.

A further wire guide 43, formed by two rings 44 and 45 between which the wire passes to the core, is arranged along the inner circumference of the winding wheel over the part of the wheel where the wire is taken off while being deposited on the inner surface of the core. When these rings are adjusted at the proper distance from each other and from the winding ring and when they are suitably shaped, it is easy to cause the wire to extend across the inner surface of the core along a geodetic line.

The operation of this device is as follows.

After the core 10 has been arranged in the device, first the required quantity of wire is wound from a reel onto the feed reel 2 in known manner.

Subsequently, winding can commence. The wire passes from the winding wheel 1 to the core during which it is intercepted by one of the wings 24 or 25 which guides the wire to a location on the gear ring 17 from where it passes (now from the winding wheel between the rings 44 and 45) over the inner surface of the core to the wire guide 31 which arranges the wire in a given position on the upper surface of the core. The wire passes from this location to the gear ring 17 again.

The motor 22 is controlled according to a given program in order to deposit the wire in a given desired location on the gear ring 17 by the positioning of the wire guides 24, 25. From this location the wire always passes to the wire guides 31. The windings can thus be deposited on the core at any given degree of slant. If desired, the degree of slant can also be varied during winding.

The motor 19 with gearwheel 18 ensures that the core is again rotated according to a desired program.

What is claimed is:

1. In an apparatus for winding toroidal coils comprising a rotatable winding wheel lying in a plane, a part of said wheel being detachable for insertion of a core on which a winding is to be wound, the core having first and second end faces, means for rotating said core about a first axis, and a first wire guide adjacent said first end face, an improved wire guide arrangement allowing the slanted winding of coils, comprising an annular member, means for pivoting said annular member about said first axis, and a second wire guide connected to said annular member for pivotal motion therewith, said second wire guide comprising two wire interceptors mounted on said annular member to fan out laterally from an edge of said second end face a distance such that in each position of the annular member one of the wire interceptors intercepts the plane of the winding wheel.

2. An apparatus as claimed in claim 1, comprising in addition means for mounting said first wire guide for pivotal movement about a second axis lying in the plane of the winding wheel and substantially tangent to an outer circumference of the first end face, said first wire guide having an inlet, and means for coupling said mounting means to said annular member such that the inlet of the first wire guide points in a direction toward the second wire guide.

3. An apparatus as claimed in claim 2, wherein said annular member pivoting means comprises a drive unit, and means for positioning the second wire guide with respect to the core in accordance with a predetermined relationship.

4. An apparatus as claimed in claim 2, wherein said first wire guide comprises two first parts extending parallel to each other, a second part, means for pivotally connecting said first parts to said second part about a third axis transverse to the plane of the winding wheel, a yoke, means for pivotally connecting said second part to said yoke for pivotal motion about said second axis, guide means for positioning said yoke axially with respect to the core, and roller means connected to said second part for pressing downward on an upper edge of the core.

5. An apparatus as claimed in claim 4, wherein said means for rotating said core comprises means for positioning said core about said axis in accordance with a predetermined relationship.

6. An apparatus as claimed in claim 4, further comprising means for controlling the pivotal angle between said first parts and said second part, said second part being a second annular member, said controlling means comprising a third annular member having ends connected to corresponding first parts so as to hold them parallel to each other, and controllable drive means connected between corresponding portions of said second and third annular members for pivoting said first parts about said third axis.

* * * * *